US006085951A

United States Patent [19]

Beletsky et al.

[11] Patent Number: 6,085,951

[45] Date of Patent: Jul. 11, 2000

[54] SECONDARY LATCHING DEVICE FOR HOLSTERS

[75] Inventors: Robert J. Beletsky; Anthony G. Lefeber; Carl R. Eerdmans, all of Temecula, Calif.

[73] Assignee: Bianchi International, Temecula, Calif.

[21] Appl. No.: 09/111,449

[22] Filed: Jul. 8, 1998

Related U.S. Application Data

[60] Provisional application No. 60/052,089, Jul. 9, 1998.

[51] Int. Cl.[7] ..... F41C 33/02

[52] U.S. Cl. ..... 224/243; 224/242; 224/244; 224/250; 224/911

[58] Field of Search ..... 224/243, 244, 224/250, 911, 912; 150/118, 119; 190/120

[56] References Cited

U.S. PATENT DOCUMENTS

| | | | |
|---|---|---|---|
| 4,277,007 | 7/1981 | Bianchi et al. . | |
| 5,129,562 | 7/1992 | Bianchi . | |
| 5,199,620 | 4/1993 | Beletsky . | |
| 5,246,153 | 9/1993 | Beletsky . | |
| 5,351,868 | 10/1994 | Beletsky et al. . | |
| 5,501,380 | 3/1996 | Wu | 224/243 |
| 5,632,426 | 5/1997 | Beletsky et al. | 224/243 |

*Primary Examiner*—Allan N. Shoap
*Assistant Examiner*—Maerena N. Brevard
*Attorney, Agent, or Firm*—John E. Wagner; Robert C. Smith

[57] ABSTRACT

A handgun holster with an auxiliary or supplementary latching device is disclosed. The holster includes a body which defines a pouch for holding a handgun and includes a strap which extends over or around a portion of the handgun to hold it in place in the holster when the free end of the retention strap is secured to the holster as by a snap fastener. In the preferred embodiment the holster includes a thumbreak which is used to allow the wearer to separate the snap fastener by downward movement of the wearer's thumb to separate the snap fastener parts and allow the handgun to be withdrawn. A supplementary latching device is present which is movable from a latching to an unlatching position. Several different embodiments of the invention are illustrated including a molded plastic latch which encircles a holster thumbreak and is slidable longitudinally along the thumbreak. Another embodiment employs a metal band encircling the thumbreak with an integral spring detent which engages a recess in the thumbreak to provide a tactile or audible indication of latching operation. Another version includes a molded cap for a thumbreak with a throat like opening for receiving a snap fastener male part with an encircling rimmed cup. Fingergrip recesses are present in the cap. In another embodiment, the supplementary latching device includes two parts, one secured to the thumbreak and a second which is in slidable transverse relationship with thumbreak and the first part.

22 Claims, 18 Drawing Sheets

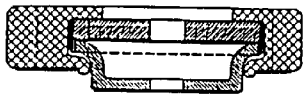
FIG. 12
FIG. 11
FIG. 13
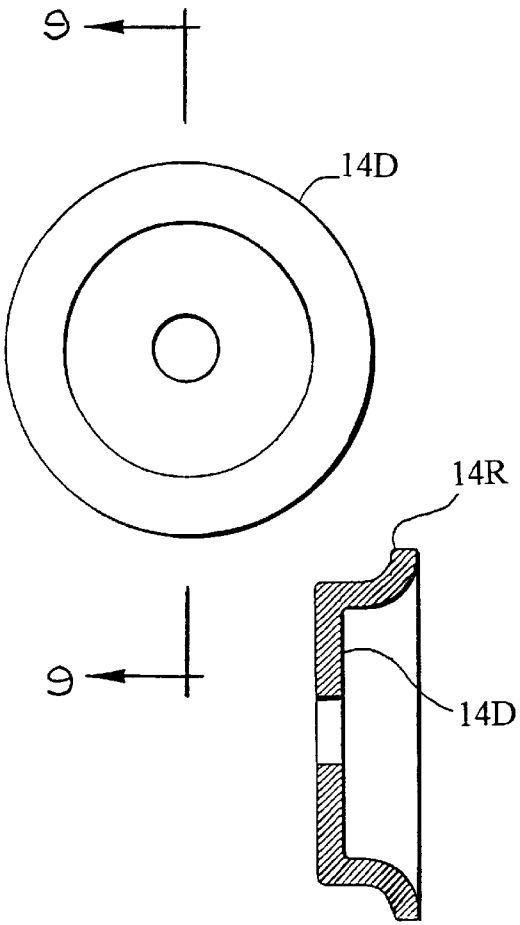
FIG. 10
FIG. 9

SECONDARY LATCHING DEVICE FOR HOLSTERS

REFERENCE TO RELATED APPLICATION

This application is a non provisional application based upon provisional application serial No. 60/052,089 filed Jul. 9, 1998.

BACKGROUND OF THE INVENTION

In the field of holsters, particularly for law enforcement use and sporting holsters, as well, it is desirable to add an additional handgun retention device to the classic strap which customarily is snap fastened over the grip of the handgun. Also, holsters are designed and used for carrying other objects, which need to be reliably retained. They include radios, cellular telephones, knives, and other forms of wearable appliances. Such additional retention devices serve to provide a greater degree of security to the wearer of the holster.

A common need for such additional retention device is during physical exertion which may be in running or climbing fences as is encountered by both law enforcement officers and sportsmen alike. The wearer would prefer not to have to be concerned about the strap becoming undone and the weapon fall out of his holster or in extreme cases being dislodged by an assailant.

Two different approaches to additional retention devices have developed in recent years. The first approach involves the internal latching device which grips a portion of the handgun and provides additional resistance to handgun withdrawal. Commonly, the trigger guard is a readily accessible part of the handgun for grasping in a jawlike grip. This type of retention device has proved eminently successful, is concealed and does not change the manner of drawing the handgun. This type of retention device is represented by the following patents, as typical:

| | | |
|---|---|---|
| 5,129,562 | John E. Bianchi | July 14, 1992 |
| 4,277,007 | Bianchi et al | July 7, 1981 |

We have also found that through a novel process for treating trilaminate fabric-foam-fabric holster materials that the foam and fabric of a trilaminate may be selectively compressed to provide additional withdrawal resistance force upon selected handguns to act to an extent as an additional retention device in addition to the conventional strap. Such process and product are shown in the following patent:

| | | |
|---|---|---|
| 5,351,868 | Beletsky et al | Oct. 4, 1994 |

The second approach to supplementary handgun retention involves the use of an addition to the strap clasp. Sometimes, multiple straps and multiple fasteners are used for supplemental handgun retention. Traditionally, the holster strap has been closed by a snap fastener including those which release when the strap end is lifted from one direction only. Snap fastening straps in holsters in which a movement of the thumb separates the two ends of the holster strap. These are usually referred to as "thumbreak" holsters and are typified by the versions disclosed in the following patents:

| | | |
|---|---|---|
| 5,246,153 | R. J. Beletsky | Sept. 21, 1993 |
| 5,199,620 | R. J. Beletsky | April 6, 1993 |

This last patent involves the use of a rotating latching device which is designed to prevent the unlatching of a thumbreak type strap until a latch mechanism is rotated 90 degrees prior to attempting to release the thumbreak.

A continuing need exists for refined supplementary retention devices which do not restrict the wearer by requiring unnatural movements or visual observation of the supplemental retention device during either latching or unlatching. The device must also be concealed from adversaries or located and designed in a manner which helps prevent the release of the handgun by intentionally or inadvertently by others while being worn by the police officer or sportsman.

BRIEF DESCRIPTION OF THE INVENTION

Faced with this state of the art, we sought to provide a supplemental latching device which is associated with the thumbreak of a holster, next to the wearer's body and concealed from the exterior. We sought such a latching device which may be operated from latched to unlatched or unlatched to latched in virtually the same operations as used in drawing and replacing the handgun from the holster, namely a generally downward movement of the thumb in releasing the thumbreak or a thumb and forefinger snapping operation in closing the snap in a conventional thumbreak holster.

We also sought to invent a mechanism which is equally useful in duty holsters worn by uniformed officers, sportsmen and plain clothes officers, as well, who carry concealed weapons including those who carry their handgun inverted or in any under the jacket configuration. In fact, the need existed for supplemental latching devices will work with any holster position on the body (belt, shoulder, ankle, back, etc.)

A major consideration, likewise, was to invent a supplemental latching device which would resist being overcome by would-be assailants by any type of grasping, jerking or blow to the holster. The latching device was also sought to be concealed to an extent that the motion of latching or releasing the latch is nearly unnoticed by bystanders.

These objectives are met in one or more of three versions or embodiments of this invention.

Version I

The first version employs a generally rectangular cross section sleeve or slide of metal or plastic which encloses the thumbreak of a thumbreak holster. This sleeve or slide moves along a limited length of the thumbreak and includes a valley like recess in the side of the thumbreak which adjoins the strap of the holster and engages a rimmed disk encircling a conventional snap fastener part. When the slide is a first or latched position the edge of the valley like recess engages the rim of the disk and when withdrawn by sliding away, the snap fastener of the thumbreak holster may be separated in its usual manner. In this embodiment, the latched position is up and the action of the wearer in pressing his thumb down between the thumbreak and the strap to open the snap fastener can also release the slide latch before the thumbreak may be released.

Version II

In another embodiment, the direction of latching is reversed, namely a downward push of the hand engages the latching device, for example, when a wearer begins strenuous activity such as a chase. Unlatching, in this case, involves an upward pressure between the thumb and forefinger to lift the latch just before the thumb enganges the thumbreak.

Version III

One further embodiment of this invention includes a sliding latch in which the latch moves laterally from an latched to an latched position, again by a thumb movement as the wearer grasps the handgun grip and moves his thumb toward the thumbreak. The sliding latch of this embodiment also has the feature of accepting other shaped latching devices such as the L shaped latch secured to the snap fastener rather than the rimmed dish of the first two versions of the invention. In this case the mere act of the officer swinging his hand rearward adjacent to the thumbreak will latch the supplemental restraint. This version may be considered generic to thumbreak holsters in general, regardless of how they are worn since the slide movement is transverse to the length of the thumbreak strap.

BRIEF DESCRIPTION OF THE DRAWING(S)

This invention may be more clearly understood with the following detailed description and by reference to the drawings in which:

FIG. 9 is a diametrical sectional view of a formed metal rimmed disk portion of the clasp of FIGS. 3–8;

FIG. 10 is a top plan view of the rimmed disk of FIG. 9;

FIG. 11 is a front elevational view of the thumbreak strap of a plastic molded embodiment of the supplementary latching mechanism of FIGS. 3–8 in an up or latched condition with portions in section to showing the internal detent mechanism;

FIG. 12 is a transverse sectional view of the strap assembly of FIG. 11 taken along line 12—12 of FIG. 11;

FIG. 13 is a side elevational view similar to FIG. 11 with the latching mechanism in an unlatched condition;

DETAILED DESCRIPTION OF THE INVENTION

We have sought to improve the reliability of supplemental restraint devices for holsters and the like while maintaining simplicity in design and ease of operation for uniformed officers, undercover officers employing concealed weapons and for sportsmen, as well. This is to allow the wearer to both engage and release a supplemental restraint in carrying out the natural motions used in drawing a handgun from a holster.

Version I

Figure 1:
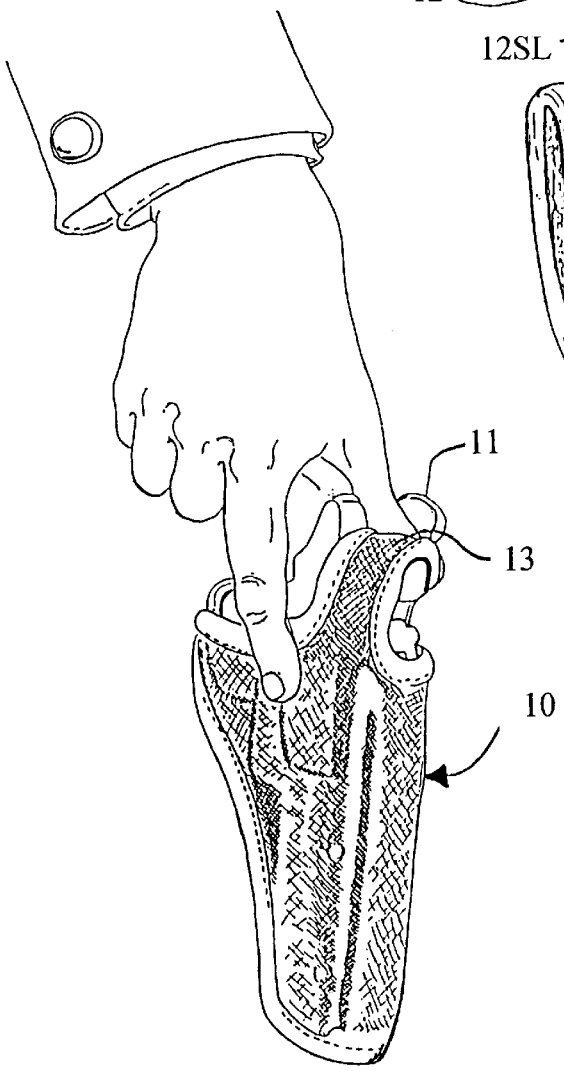
FIG. 1 is a perspective view of the hand of a person in the act of latching a belt worn holster employing a first version of a supplementary restraint device of this invention.
Figure 2:
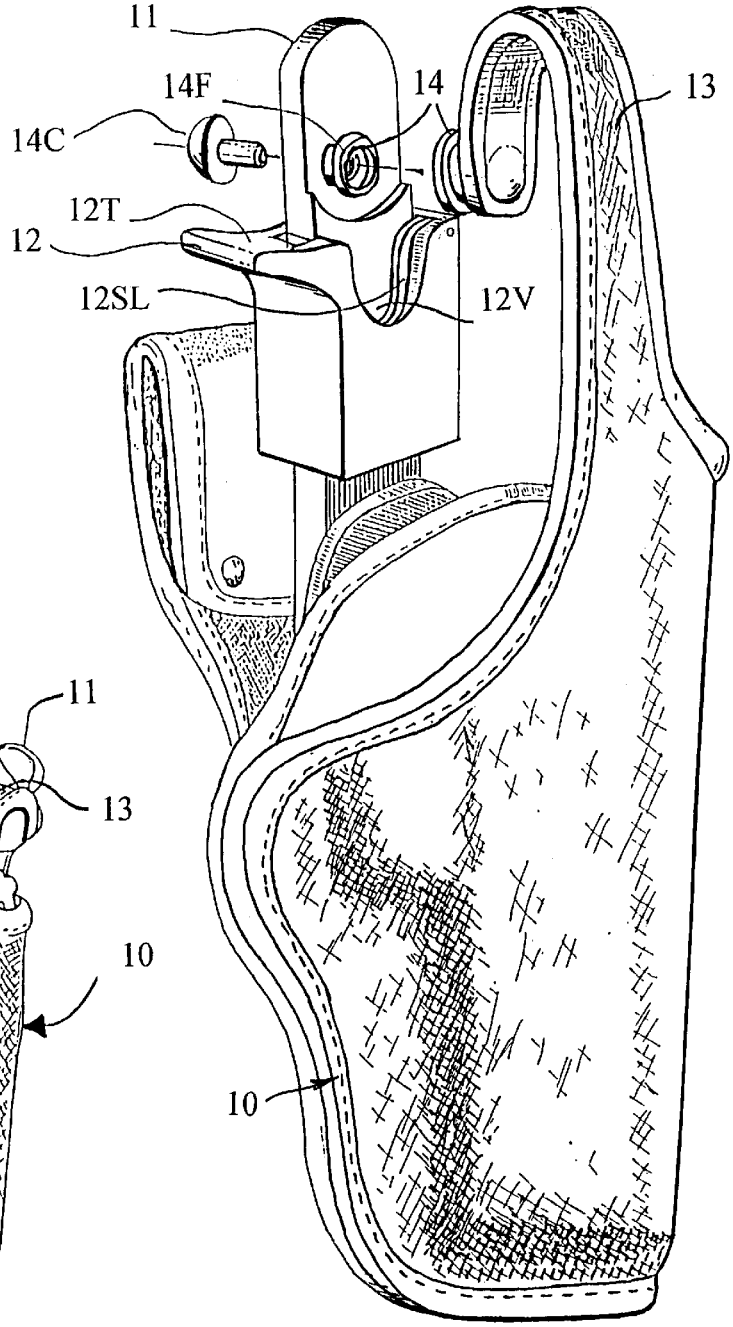
FIG. 2 is an enlarged perspective view, partly exploded showing VERSION I of this invention as applied to a thumbreak holster.

Reference is now made to FIG. 1 in combination with FIGS. 2–7. FIG. 1 shows a thumbreak holster, generally designated 10, in its normal position while being worn on a belt with the wearer grasping the handgun grip in a natural drawing motion. Unnoticed in the FIG. 1 is the fact that his thumb is both releasing the thumbreak strap 11 and a supplementary sliding LATCH 12 both shown in FIG. 2 by a downward movement of the wearer's thumb to release the sliding latch 12 followed by an inward movement towards his body to separate the parts of the snap fastener 14. This latter action is accomplished by pressing his thumb between the thumbreak 11 and the strap 13 to release a special snap fastener 14 or fastening means, made up of a female socket 14F on the thumbreak 11 secured by cap 14C and a male stud 14MS on the strap 13. A concentric rimmed capture disk 14D, best seen in FIGS. 9 and 10 surrounds the stud 14MS. This concentric rimmed capture disk acts as an outward extension retention portion of the special snap fastener to allow its latching together of the mating snap fastener parts.

The slide 12 surrounds the thumbreak 11 and includes a thumb tab 12T at the top and contoured to receive the wearer's thumb as it is positioned to slide generally along the direction of elongation of the thumbreak 11 to separate the thumbreak 11 from the strap 13. The manually movable slide 12 includes a valley 12V and a slide latch 12SL which is contoured to engage the rim 14R of the capture disk 14D and prevent the release of snap fastener 14 when the slide 12 is in its uppermost or latched position.

Figure 3:
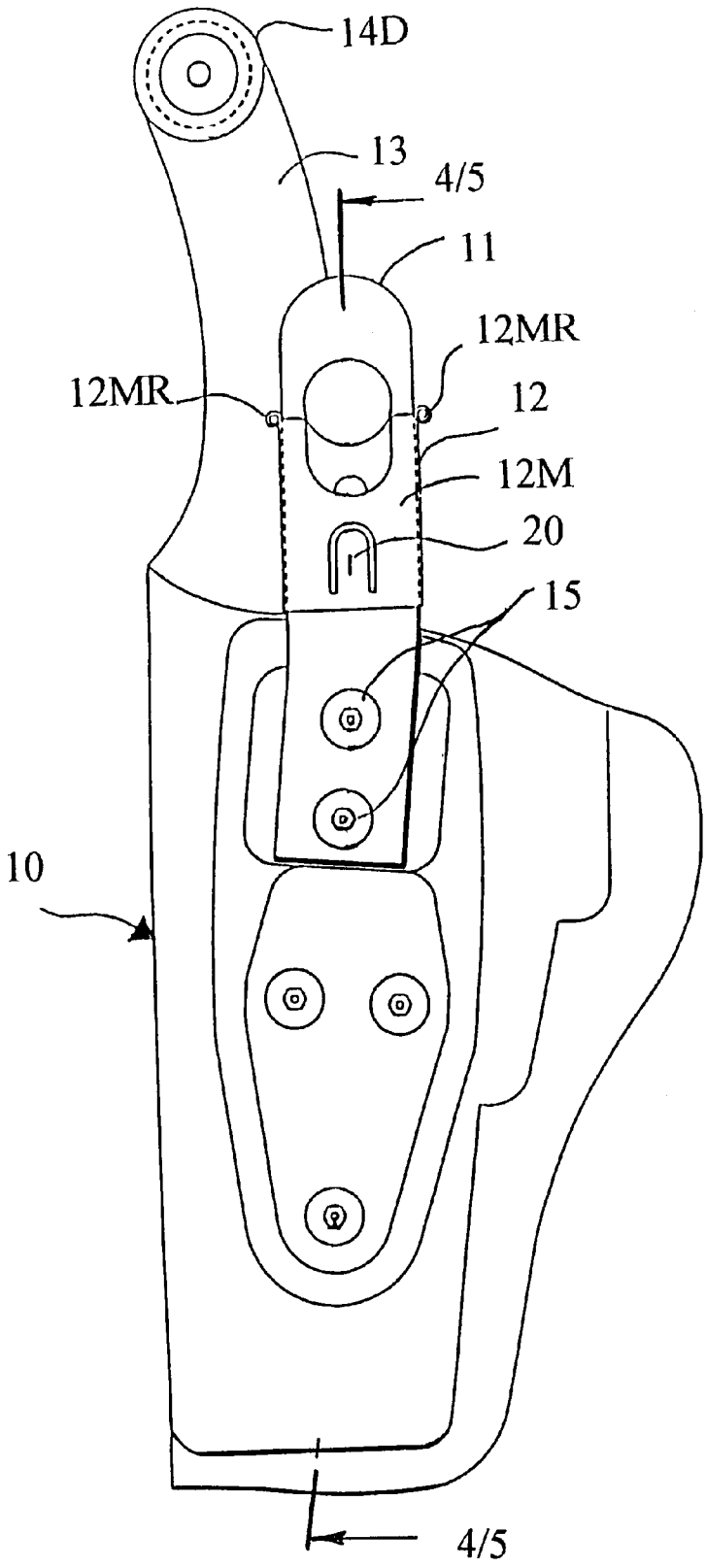
FIG. 3 is a side elevational view of a holster of the type shown in FIG. 2 with the holster belt loop assembly removed for clarity of this invention.
Figure 4:
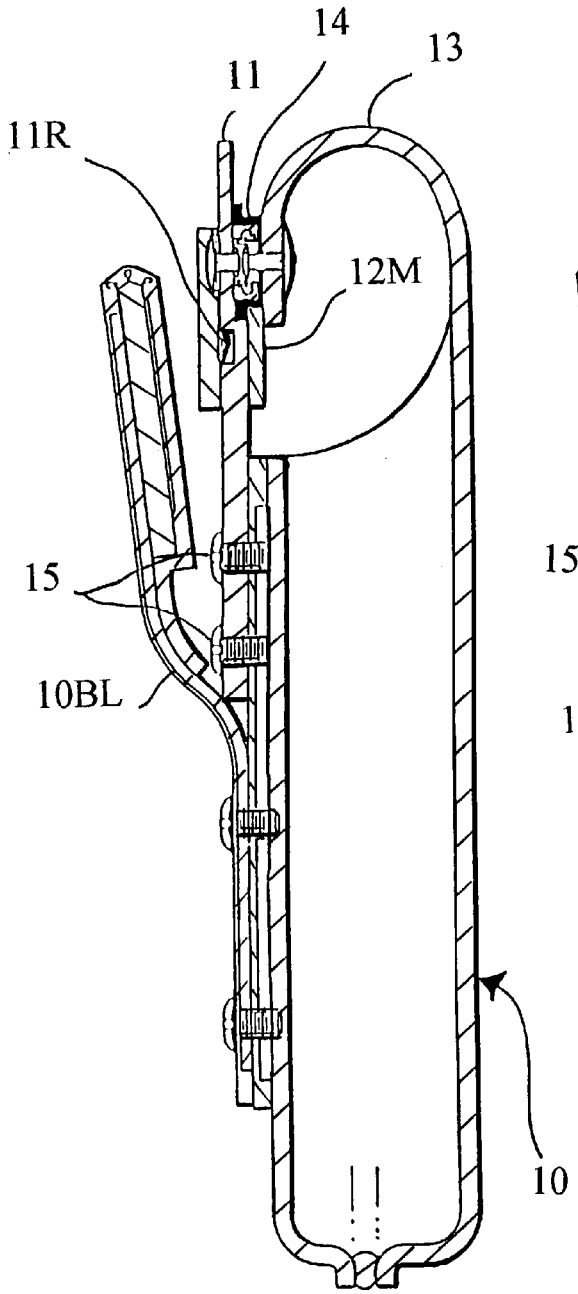
FIG. 4 is a longitudinal sectional view of the holster of FIG. 3 with the strap engaged and in a latched condition taken along line 4/5—4/5 of FIG. 3 with the belt loop assembly in place.
Figure 5:
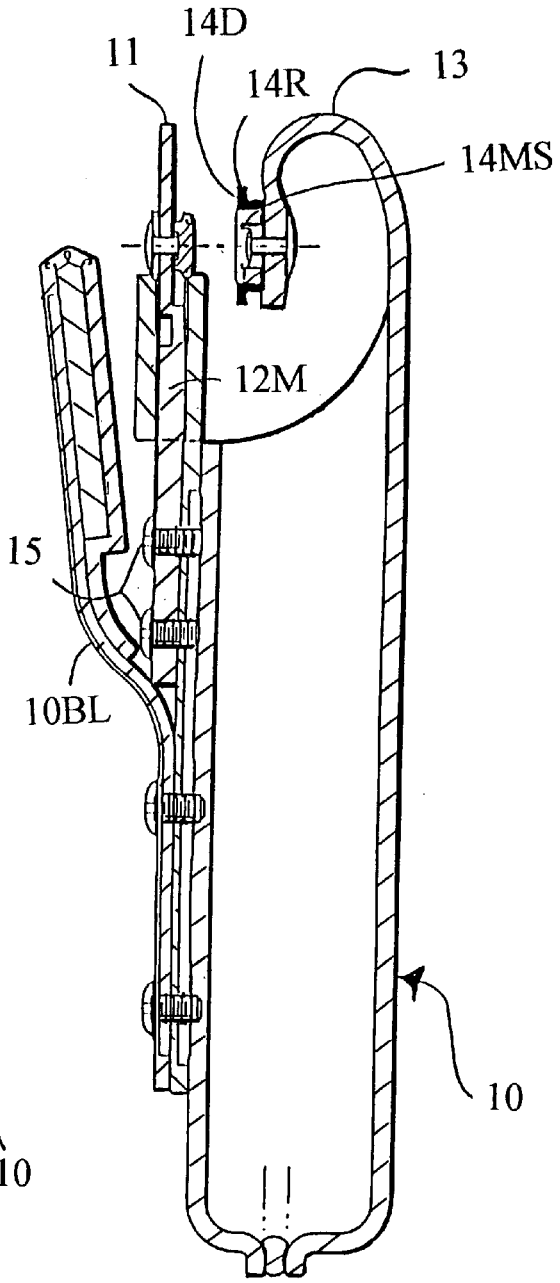
FIG. 5 is a longitudinal sectional view of the holster of FIG. 3 with the strap disengaged also taken along line 4/5—4/5 of FIG. 3.

FIGS. 3–7 show this invention in which the slide 12 is fabricated solely as a metal part 12M. In this embodiment a detent 20 is formed integrally in the side wall of the slide 12M to fall into a mating recess 11R in the thumbreak 11 when the slide 12M is in its upper or LATCHED position as shown in FIG. 3 or in the strap disengaged or UNLATCHED condition as shown in FIGS. 3 and 5. FIGS. 3–5 also illustrate that the thumbreak 11 can be secured to the holster 10 body by fasteners 15 and the location and details of the beltloop assembly 10BL. The belt loop assembly 10BL and the thumbreak 11 may be attached to the holster body 10 in any number of well known ways.

Figure 6:
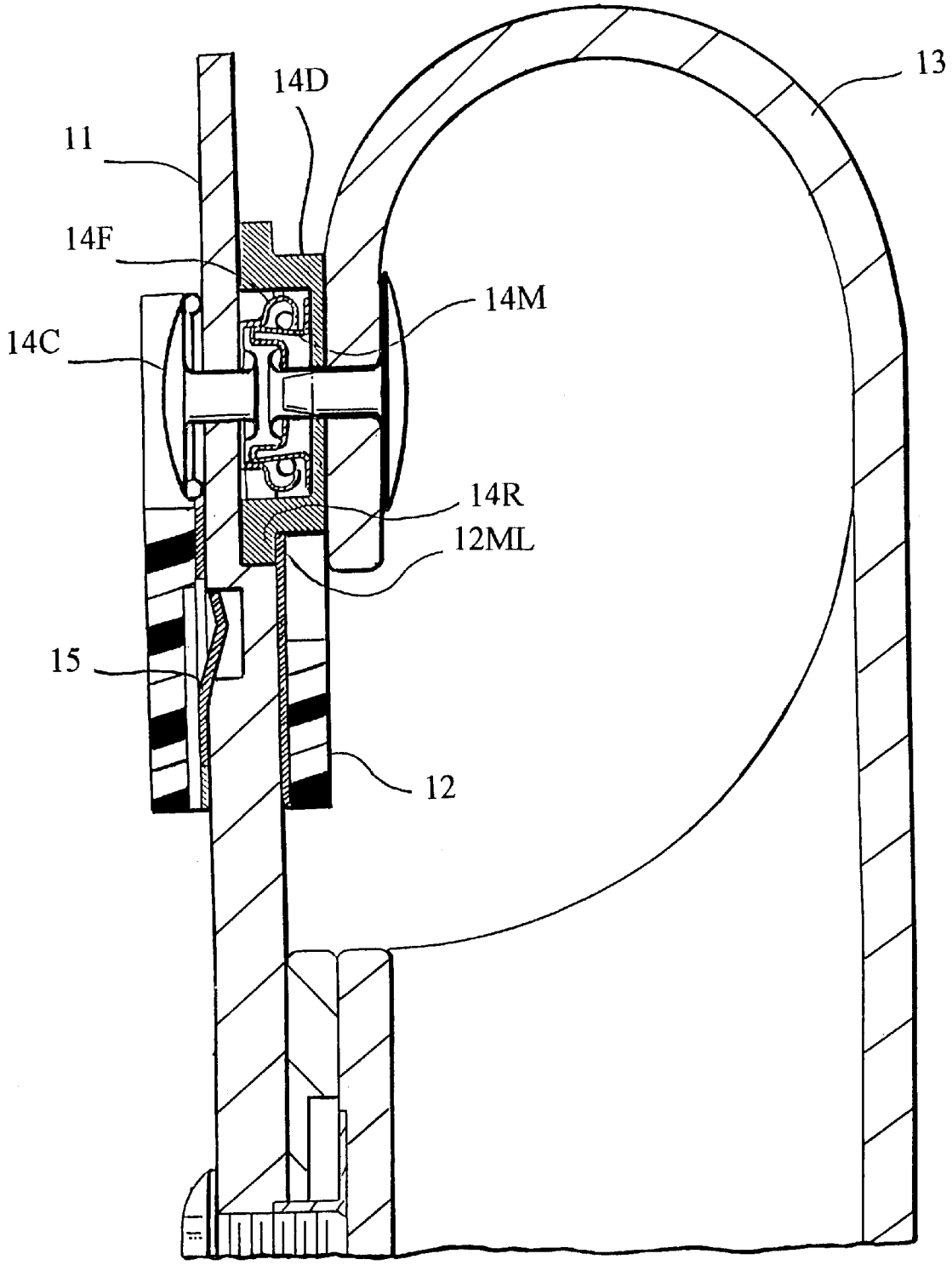
FIG. 6 is an enlarged fragmentary sectional view of the holster of FIGS. 3–5 shown in a latched condition.

FIG. 6 illustrates the VERSION I of this invention in its LATCHED condition in which the metal liner 12ML of the slide 12 engages the underside of the rim 14R of the disk 14D. There is engagement between the metal liner 12ML and the disk 14D over at least the lower half of the disk 14D for a solid engagement. The thumb tab 12T of FIG. 2 or the rolled over metal edges 12MR are effective for actuating the slide 12.

Figure 7:
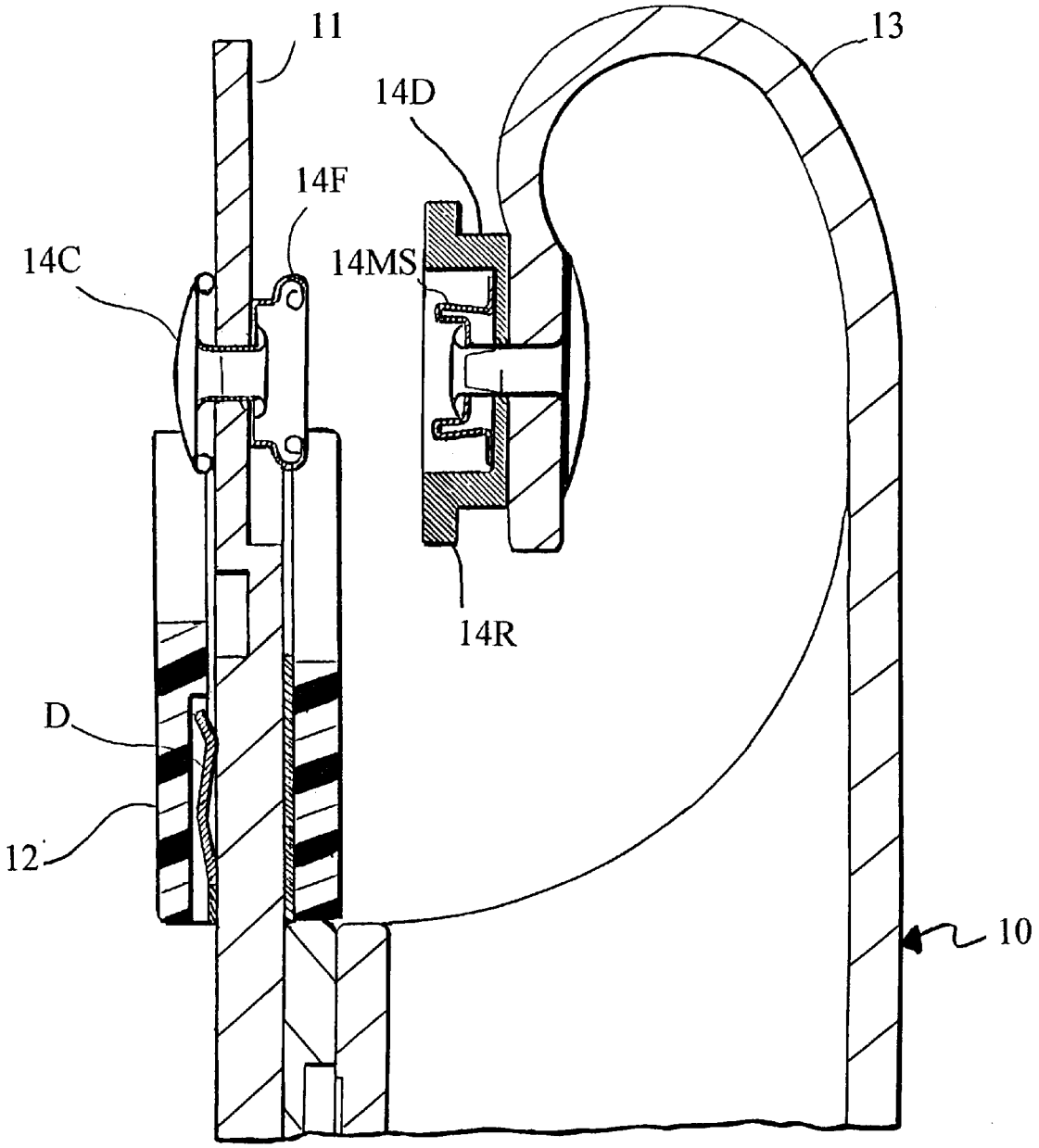
FIG. 7 is an enlarged fragmentary sectional view of the holster of FIGS. 3–5, similar to FIG. 6 with the clasp released.

FIG. 7, by way of contrast, shows the slide 12 in its lowered UNLATCHED position and the strap 13 released from the thumbreak 11 in its normal manner by the manual release of snap fastener 14 when the wearer's thumb is pressed downwardly between the thumbreak 11 and the strap 13 above the fastener 14 to separate the fastener parts 14F and 14M in a conventional manner for thumbreak holsters.

The strap 13 and its slightly enlarged snap fastener 14, male portion 14M and disc 14D pivot upward out of the way as the handgun, unshown, is drawn upward out of the holster 10.

Upon return of the handgun to the holster 10, the wearer engages the snap fastener 14 parts and pulls the slide 12 upward until feeling the detent 20 fall into the RECESS of the thumbreak 11 assuring the wearer that the slide 12 is secured. In FIG. 7 the detent 20 is shown in its position when the slide 12 is unlatched, bearing upon the surface of the thumbreak 11.

Figure 8:
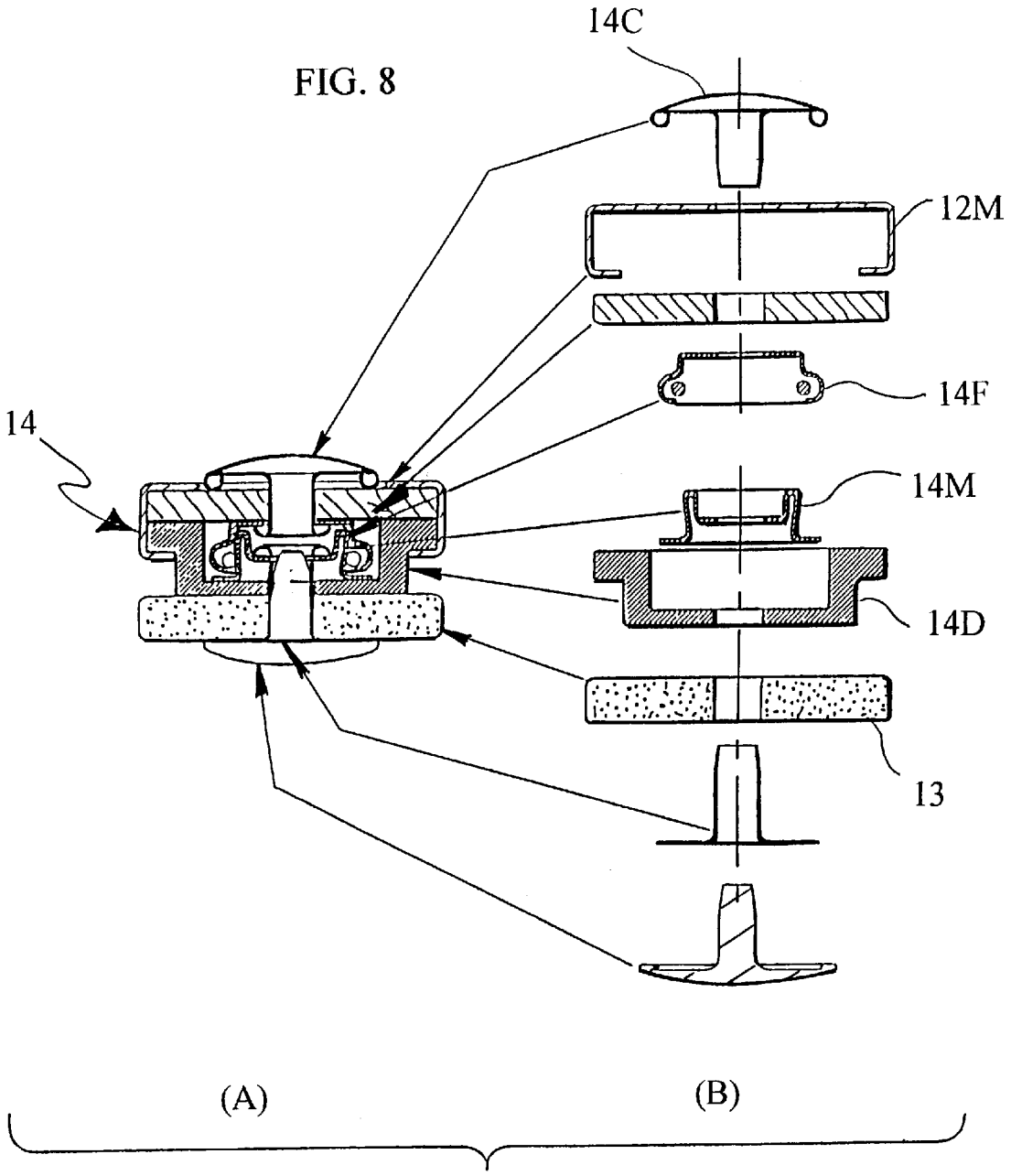
FIG. 8 is a pair of diametrical sectional views of the clasp of FIGS. 3–7, assembled and secured in FIG. 8A and exploded in FIG. 8B.
Figure 14:
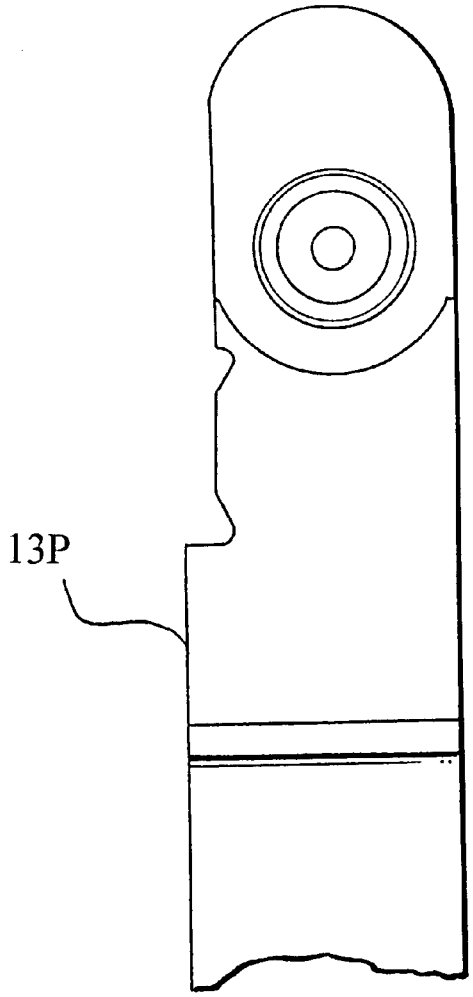
FIG. 14 is a fragmentary side elevational view, when worn, of the thumbreak strap of FIG. 11.
Figure 15:
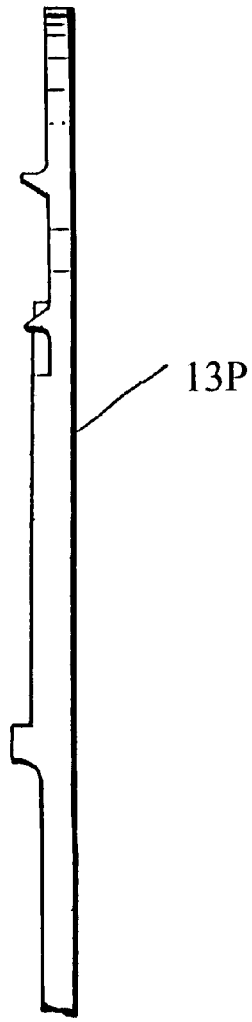
FIG. 15 is a fragmentary front elevational view, when worn, of the thumbreak strap of FIG. 11.
Figure 16:
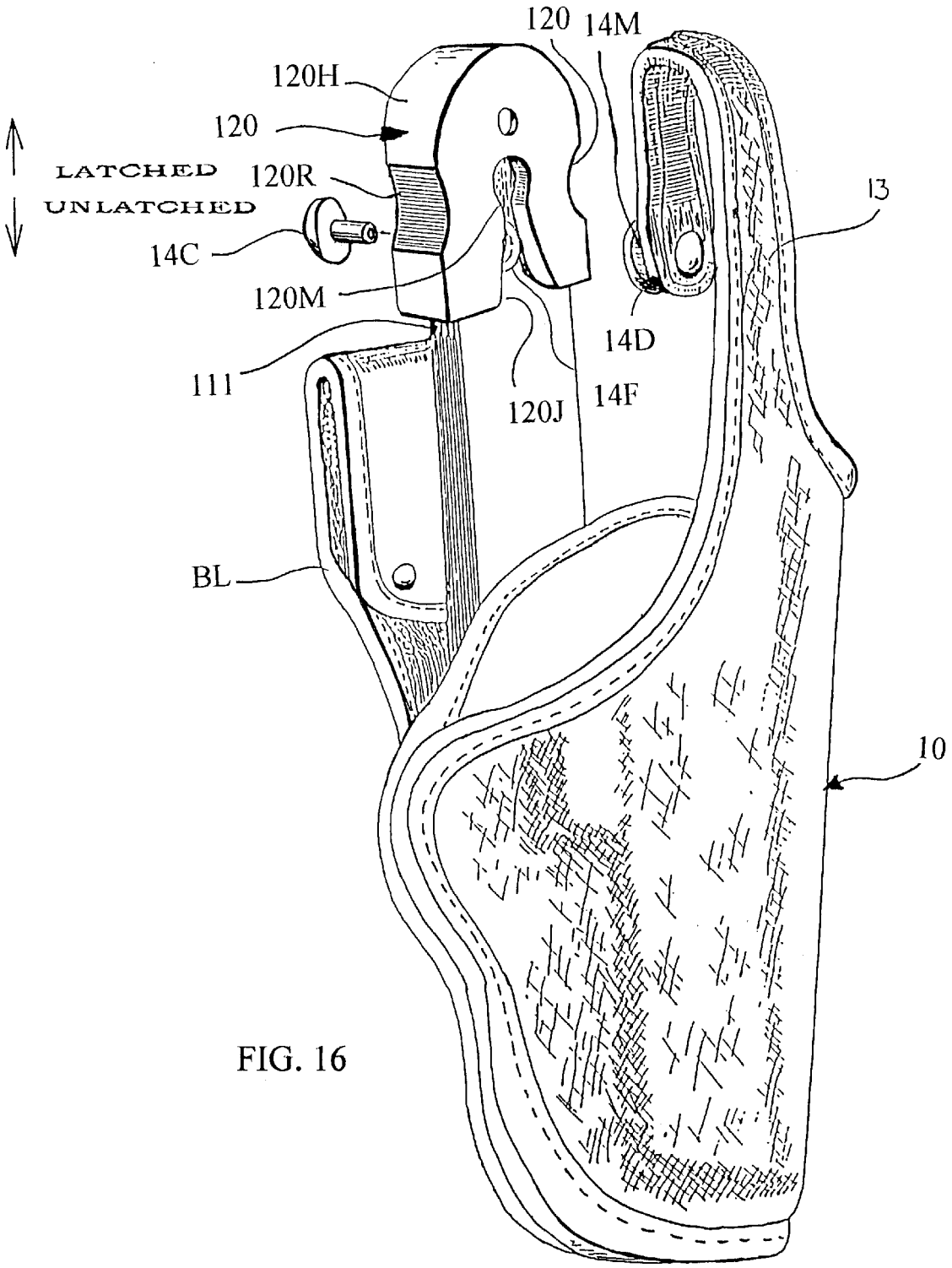
FIG. 16 is a perspective view, partially exploded, of VERSION II of this invention.

The details of the supplementary retention device using a metal slide 12M as in FIGS. 3–5 are best seen in the combination diametrical sectional view FIG. 8A and the exploded view FIG. 8B. The disk 14D is best seen in FIGS. 9 and 10.

FIGS. 11–15 illustrate an all plastic slide 12P and an all plastic thumbreak 11P. The differences from the all metal slide 12M of FIG. 3 or the combined metal/plastic slide 12 of FIGS. 6 and 7 are that the slide 12P is operated by the thumb and forefinger engaging the finger recesses 12R shown in FIGS. 11 and 13 and the integral detent 12ID rather than the metal detent 20 of FIGS. 2, 6 and 7.

Version II

Now referring to FIGS. 16–20, in which the same reference numerals are used for the same parts as found in the first version of this invention, described above. The holster 10 with its belt loop BL and strap 13 employs a thumbreak strap, in this case designated 111, which carries at its upper end a slide 120 in slidable engagement with the thumbreak 111 parallel to the length of the thumbreak 111 or vertically when the holster 10 is worn on a belt in the conventional manner.

The strap 13 carries the male portion 14M of a snap fastener 14 along with its disk 14D. The thumbreak 111 carries the female portion 14F of the snap fastener 14 and operates in the same manner as the snap fastener 14 of the earlier described version of this invention.

The slide 120 includes an enlarged head 120H and finger recesses 120R the latter being used to grasp and raise the slide 120 into an unlatched position. The slide may be latched when the snap fastener 14 is engaged as in FIG. 17 by a tap or blow in a downward direction to the head 120H of slide 120.

Figure 17:
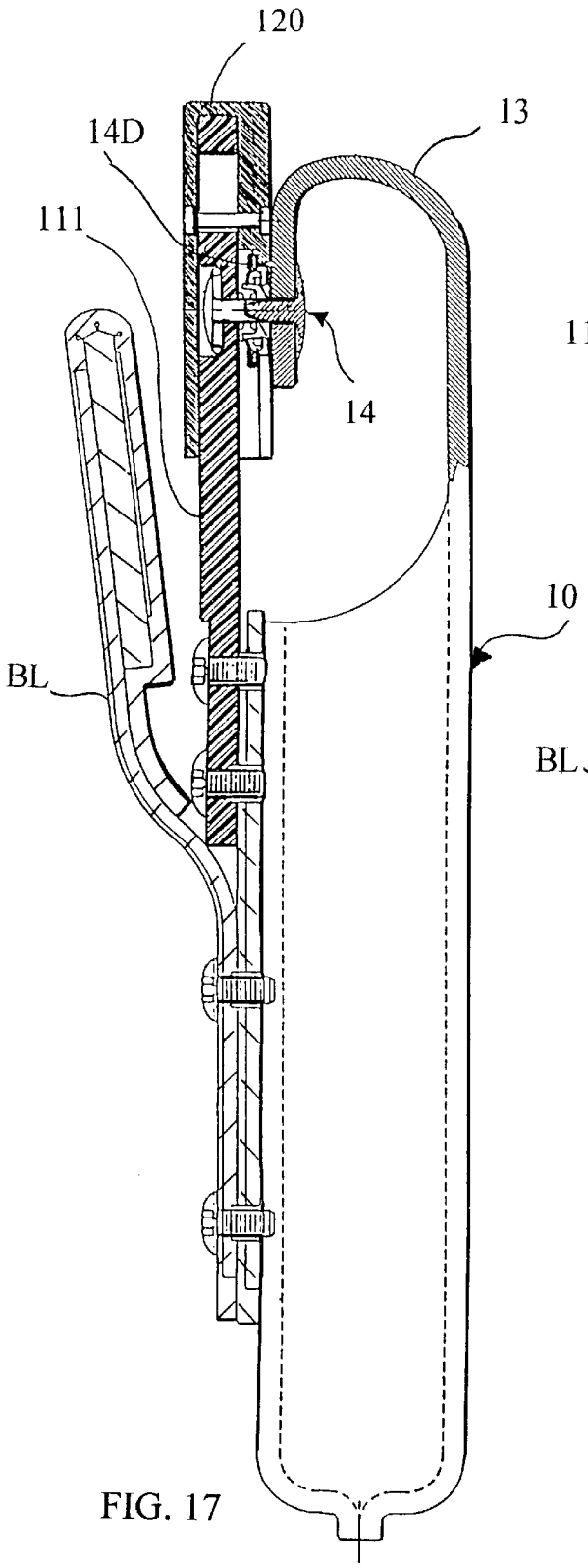
FIG. 17 is a rear elevational view of the embodiment of FIG. 16, partly in section showing the holster with the supplementary retention device in a latched condition.
Figure 18:
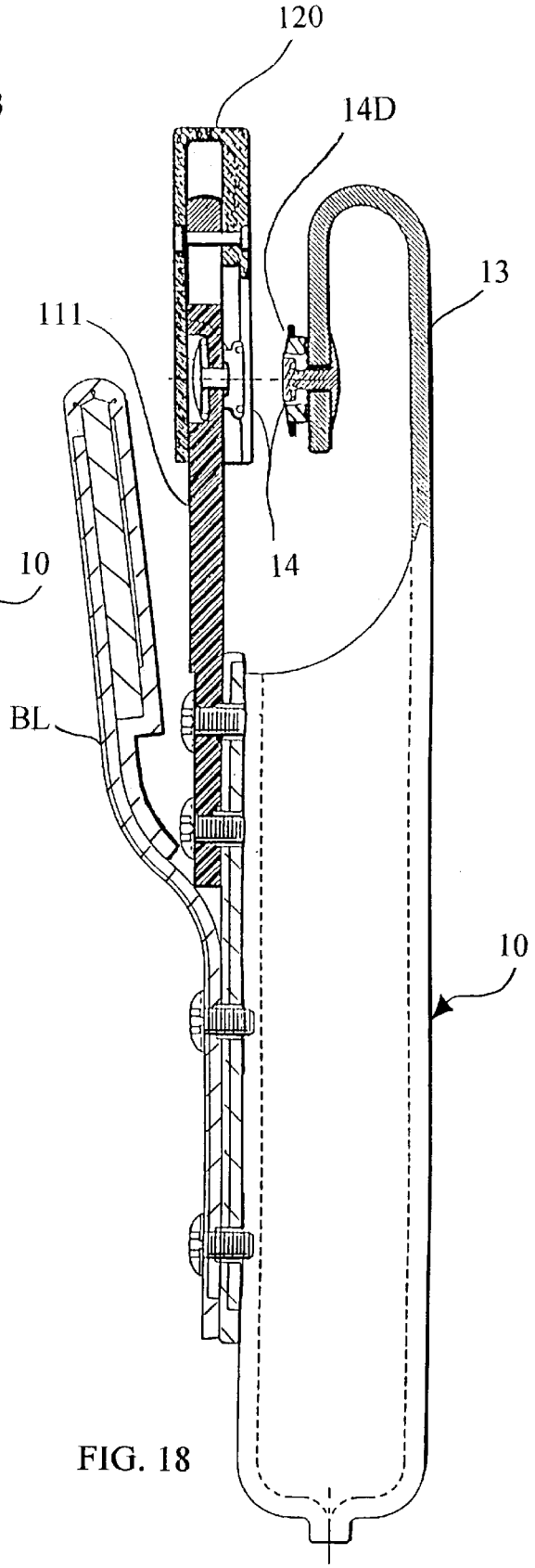
FIG. 18 is a rear elevational view of the embodiment of FIG. 16, partly in section, showing the holster with the supplementary retention device in an unlatched condition.
Figure 19:
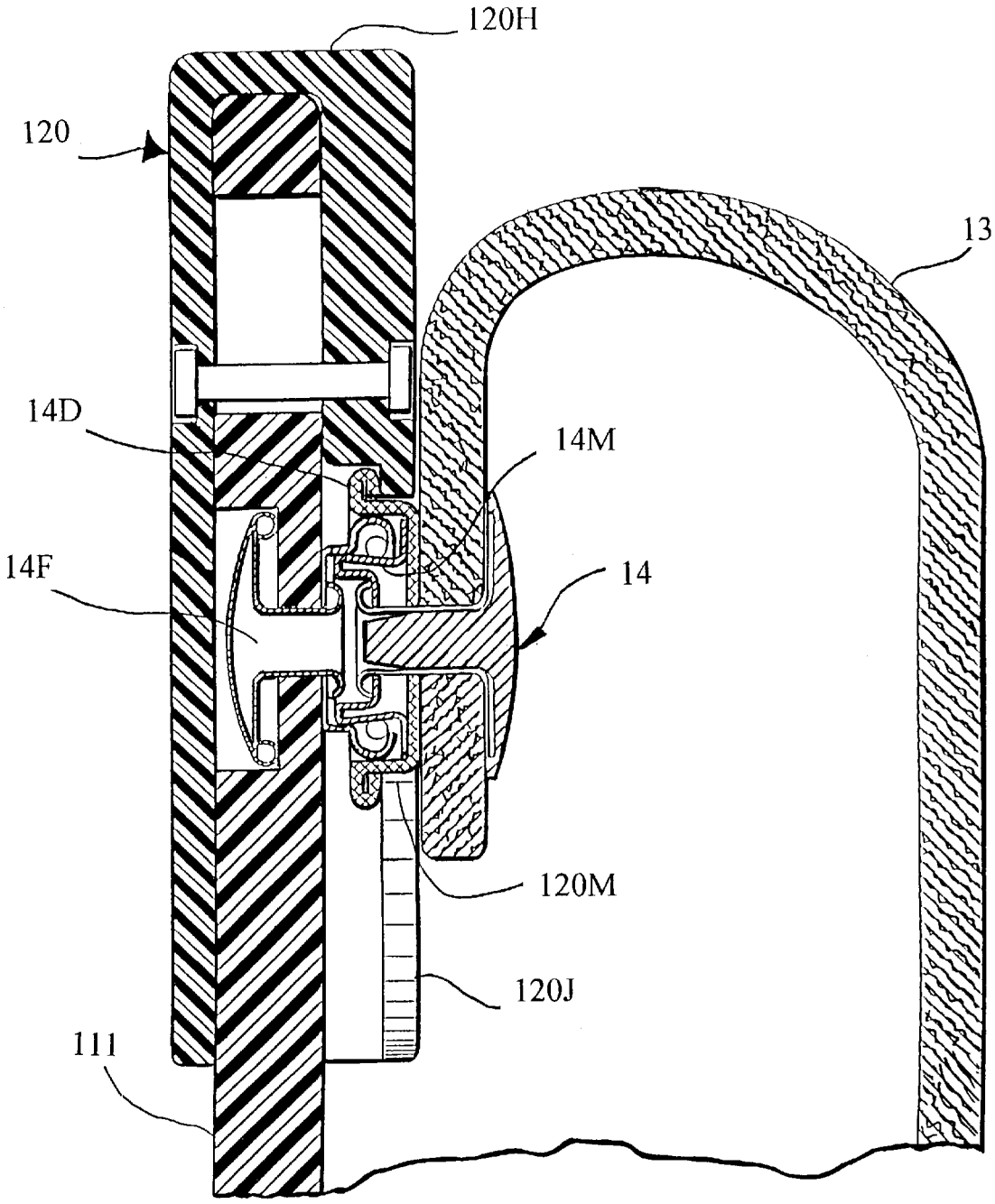
FIG. 19 is an enlarged fragmentary sectional view of the version of FIG. 16 in a latched condition with the sectional view taken in a vertical direction through the center of the supplemental retention device.
Figure 20:
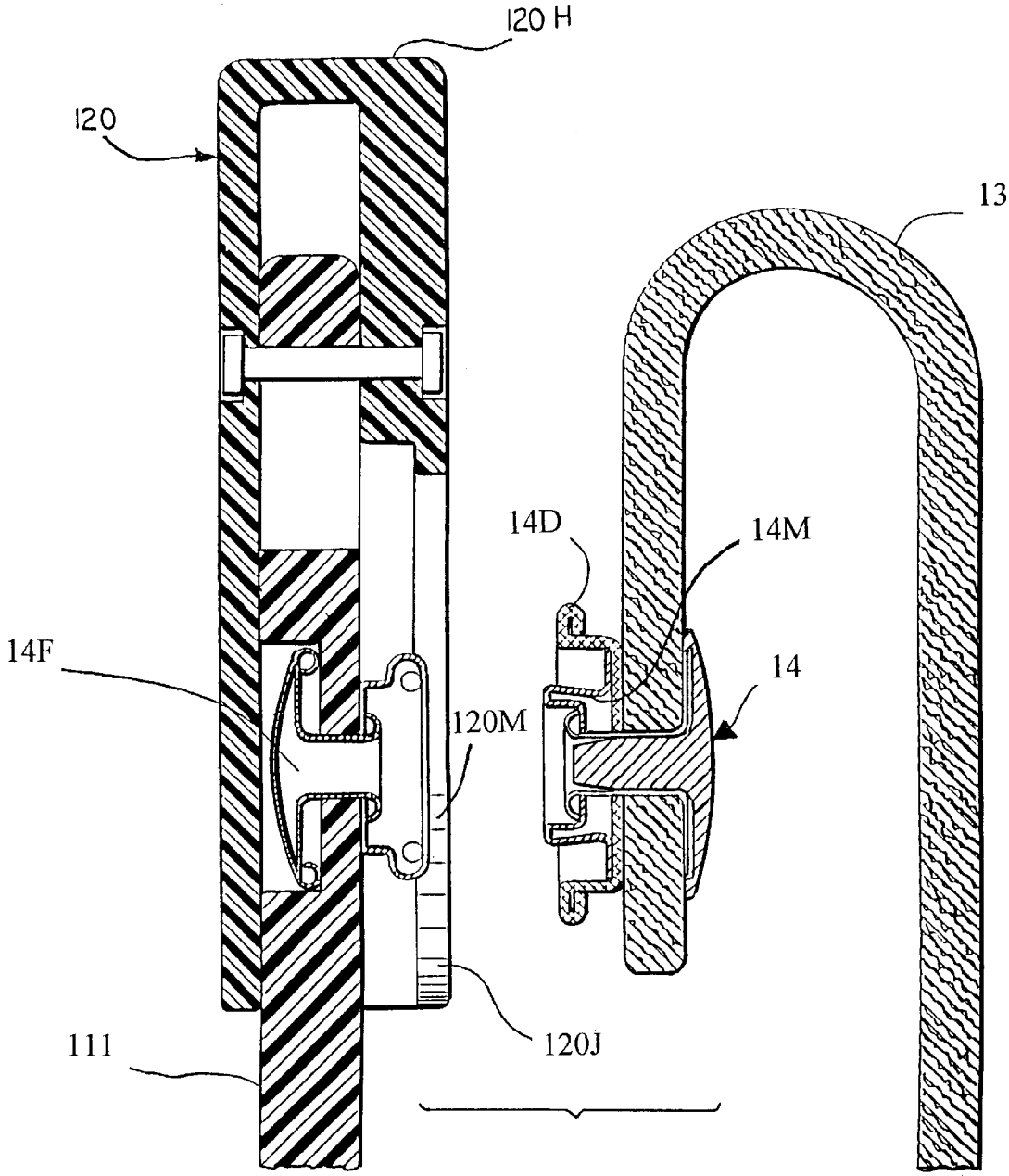
FIG. 20 is an enlarged fragmentary sectional view of the version of FIG. 16 in an unlatched and strap released condition with the sectional view taken in a vertical direction through the center of the supplemental retention device.
Figure 22:
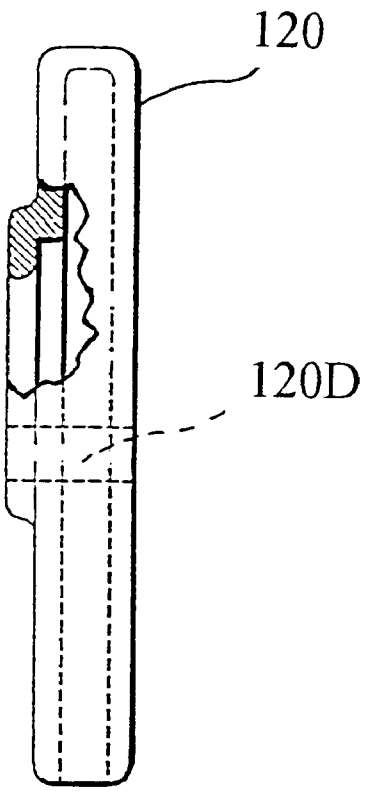
FIG. 22 is a front elevational view of the slide of FIG. 21 partly broken away for clarity.
Figure 21:
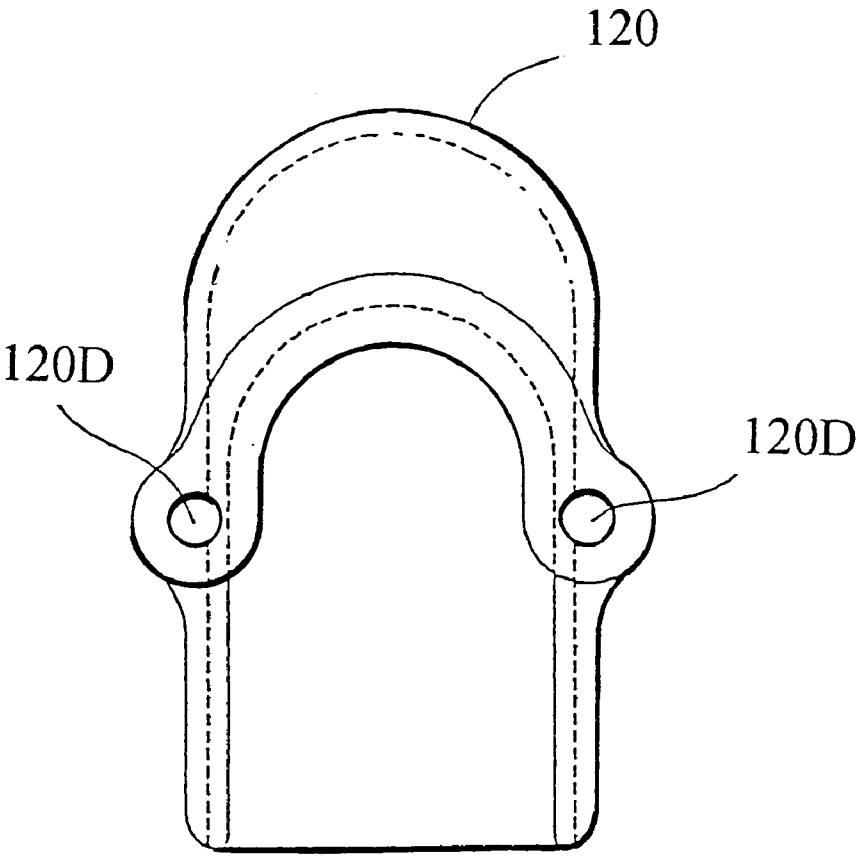
FIG. 21 is a side elevational view of an alternate form of slide for use with the embodiment of FIG. 16.
Figure 23:
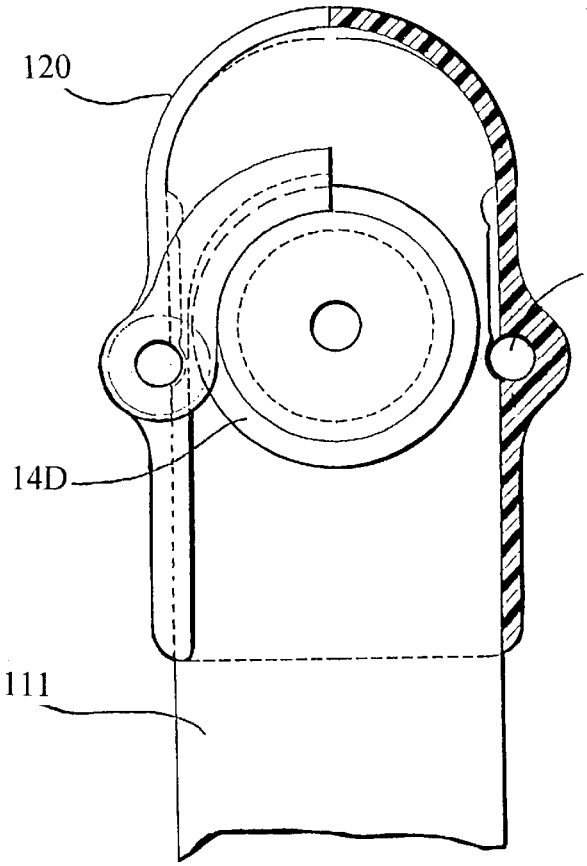
FIG. 23 is a fragmentary side elevational view, partly broken away of the slide of FIG. 21 in place on a thumbreak of VERSION II and in a slide DOWN or LATCHED position.
Figure 24:
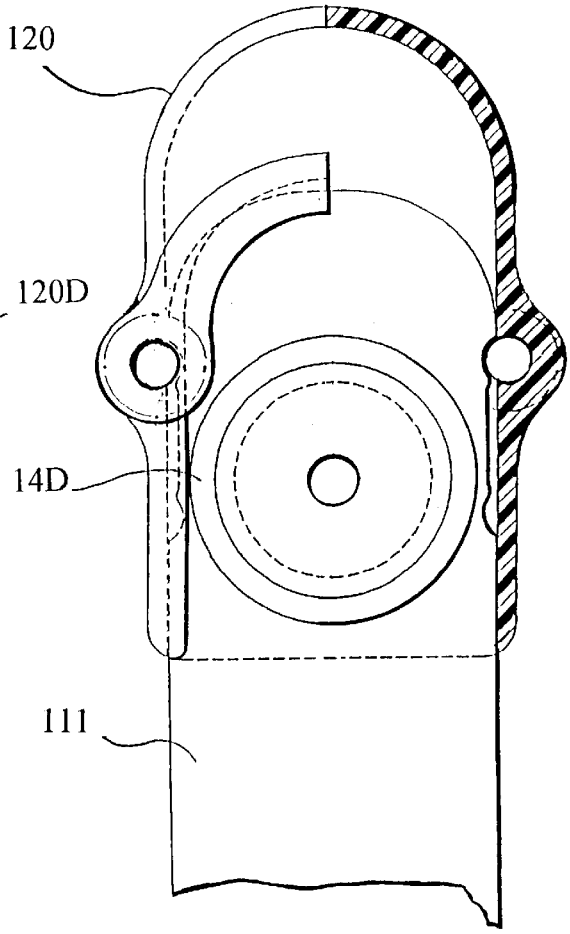
FIG. 24 is a view similar to FIG. 23 with the slide in an UP or UNLATCHED position.
Figure 25:
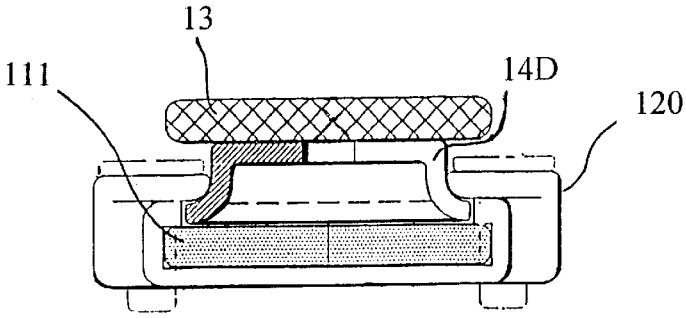
FIG. 25 is bottom plan view of the slide and thumbreak assembly of FIGS. 23 and 24.

Referring again to FIG. 16, the broad side of the slide 120 which faces the strap 13 includes at its lower edge a tapered jaw 120J which ends at a mouth 120M for receiving the fastener 14D and secure the rim of the disk 14D inside of the slide 120. The opening from the jaw 120J to the mouth 120M is sufficient to allow the passage of the rimmed disk 14D but not its rim so that the rim of disk 14D holds the strap 13 in engagement with the thumbreak 111 until the slide 120 is lifted releasing the fastener 14 to be opened by thumb pressure between the strap 13 and the thumbreak 111. The latched condition is illustrated in FIG. 17 and in unlatched condition in FIG. 18. The enlarged views, FIGS. 19 and 20 illustrate the conditions even clearer.

Figure 27:
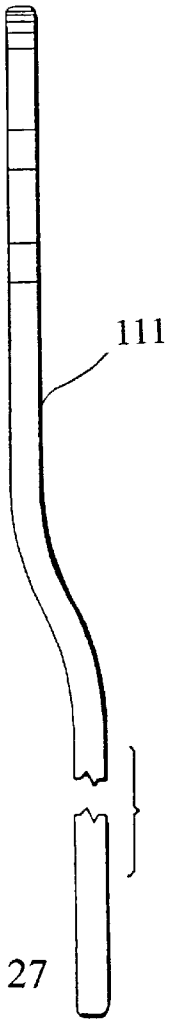
FIG. 27 is a fragmentary front elevational view of the thumbreak of FIG. 26.
Figure 26:
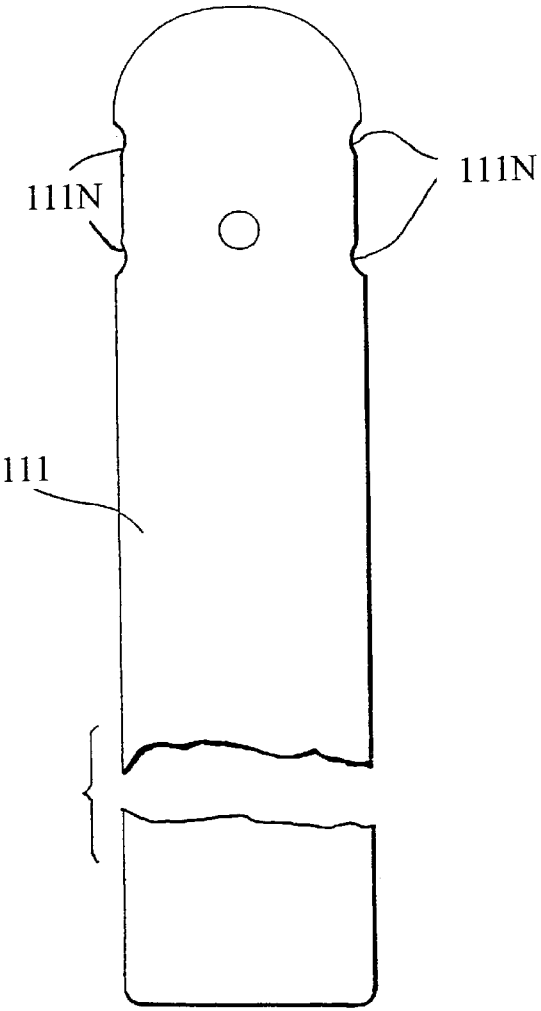
FIG. 26 is a fragmentary side elevational view of the thumbreak of FIGS. 23–25.

The preferred form of slide 120 for use in the VERSION II is shown in FIGS. 21–25. The slide 120 includes a rectangular cross section recess, best seen in FIG. 25 including pair of detents 120D in opposite edges of the slide recess to engage the corresponding notches 111N in the thumbreak 111 of FIGS. 26 and 27. The slide detents 120D engage the lower notches 111N when the slide 120 is in its LATCHED position and engages the upper notches 111N when the slide is in an UNLATCHED position. The detents give the wearer a tactile feedback when the slide 120 is fully engaged or fully unengaged as in each of the versions of this invention.

Version III

The foregoing versions of this invention each involve a slide which moves generally along the length of the thumbreak strap, either downward to unlatch and upward to latch (VERSION I) or downward to latch and upward to unlatch (VERSION II). Each has an advantage depending upon the particular requirements, holster and use.

VERSION I is best adapted to people who wish to draw a handgun with this secondary latching device in the same manner as a normal thumbreak holster. The lowering of the thumb releases the secondary latching device just before the thumbreak opens the snap fastener. Then grasping the handgun grip and lowering the thumb between the strap and the thumbreak releases the strap and the handgun may be withdrawn. Replacing the handgun requires the officer to raise the slide by grasping it and pulling it upward to a latched position. VERSION I, therefore, favors ease of drawing the handgun and is particularly suited for carrying a handgun inverted.

VERSION II, by way of contrast, allows a person to engage the secondary latching device by a rapid blow or pressure to the top of slide to move it downward and latched. An example of such a situation is where a person is about to run or climb a fence and wants further assurance of his handgun's stability in the holster. He merely strikes the top of the slide and the secondary latch is engaged. Otherwise he is wearing a normal thumbreak holster.

Figure 29:
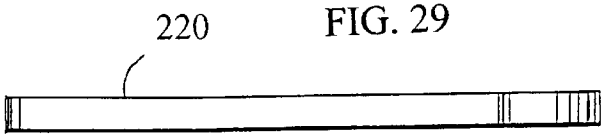
FIG. 29 is a top plan view of the slide of FIG. 28 of Version III.
Figure 28:
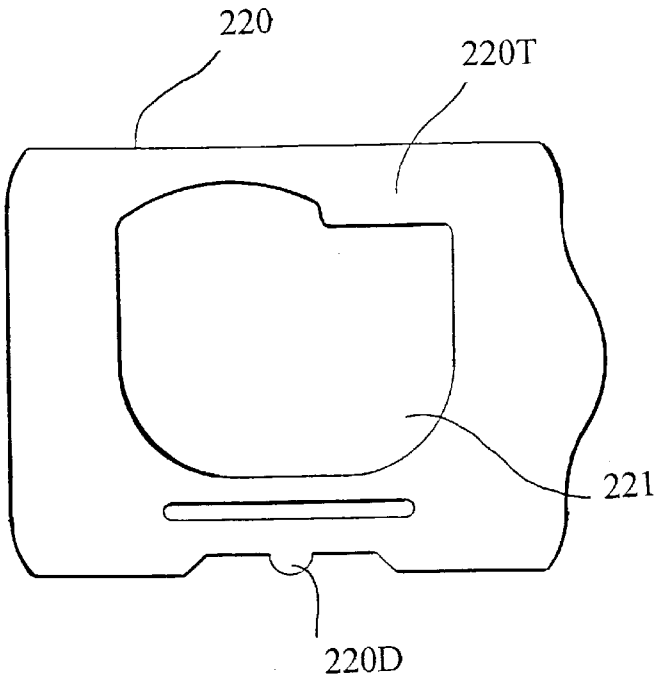
FIG. 28 is a side elevational view of the slide member of Version III.
Figure 32:
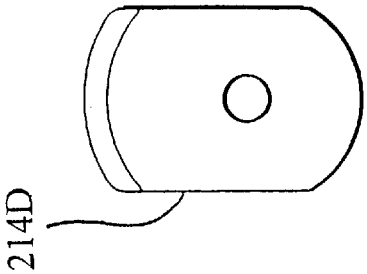
FIG. 32 is a side elevational view of an alternate form of rimmed disk for use in the VERSION III of this invention.
Figure 31:
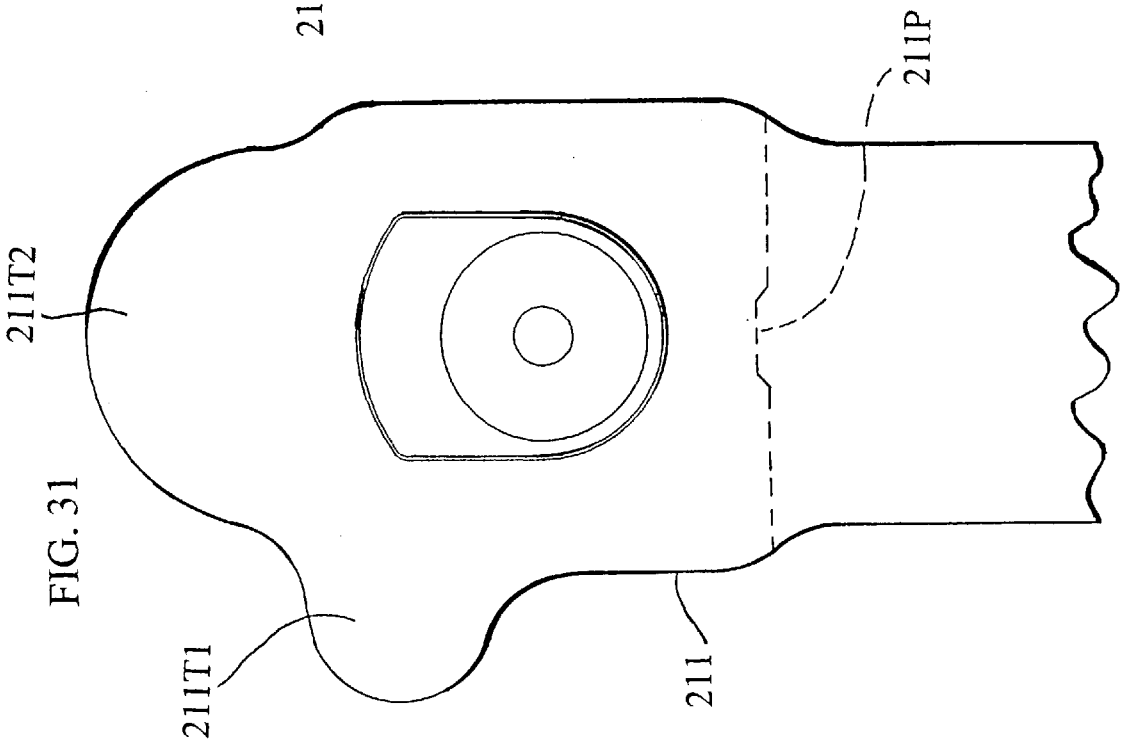
FIG. 31 is a fragmentary side elevational view of the thumbreak of FIG. 30.

In VERSION III, the slide 220 of FIGS. 28 and 29 is in the form of an apertured flat plate carrying a detent 220D as well as a bowl shaped aperture 221 having a larger opening at the left for releasing the modified disk 214D of FIGS. 31 and 32 and to the right under a tab 220 for latching the disk 214D and the snap fastener 14 of VERSIONS I and II.

Figure 33:
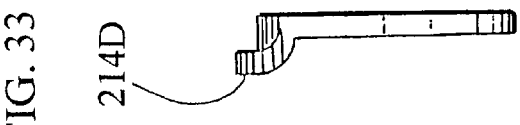
FIG. 33 is a front elevational view of the disk of FIG. 32.
Figure 30:
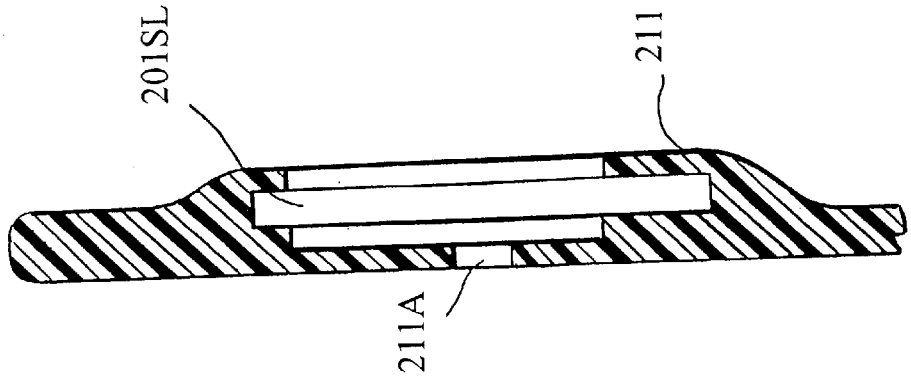
FIG. 30 is a fragmentary longitudinal section of the thumbreak of the VERSION III of this invention.

The thumbreak 211 of FIG. 30 is preferably formed from plastic as by injection molding but is not so limited and includes a slot 2015L for receiving the slide 220 and an aperture for receiving a stud, unshown for securing the disk 214D of FIGS. 32 and 33. An internal plateau 211P of FIG. 31 provides a tactile indicator of latched or unlatched condition. The thumbreak 211 also includes a pair of tabs 211T1 and 211T2. Tab 211 T1 is used to protect accidental movement of slide 220. Tab 211 T2 is used by the wearer as a thumbreak surface for releasing the fastener 14.

Figure 34:
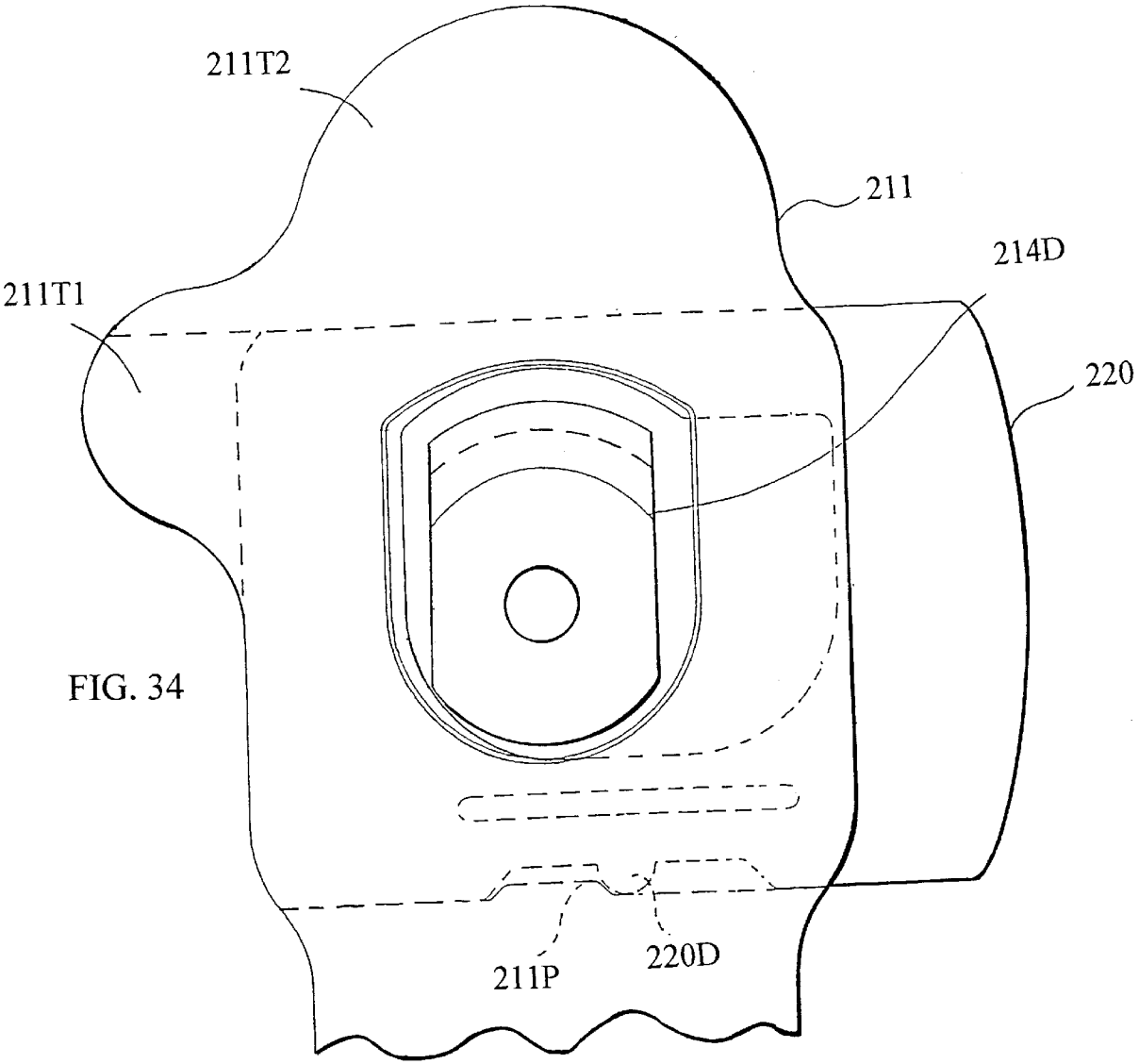
FIG. 34 is a fragmentary side elevational view of the assembled thumbreak and slide of the VERSION III in an unlatched condition.
Figure 35:
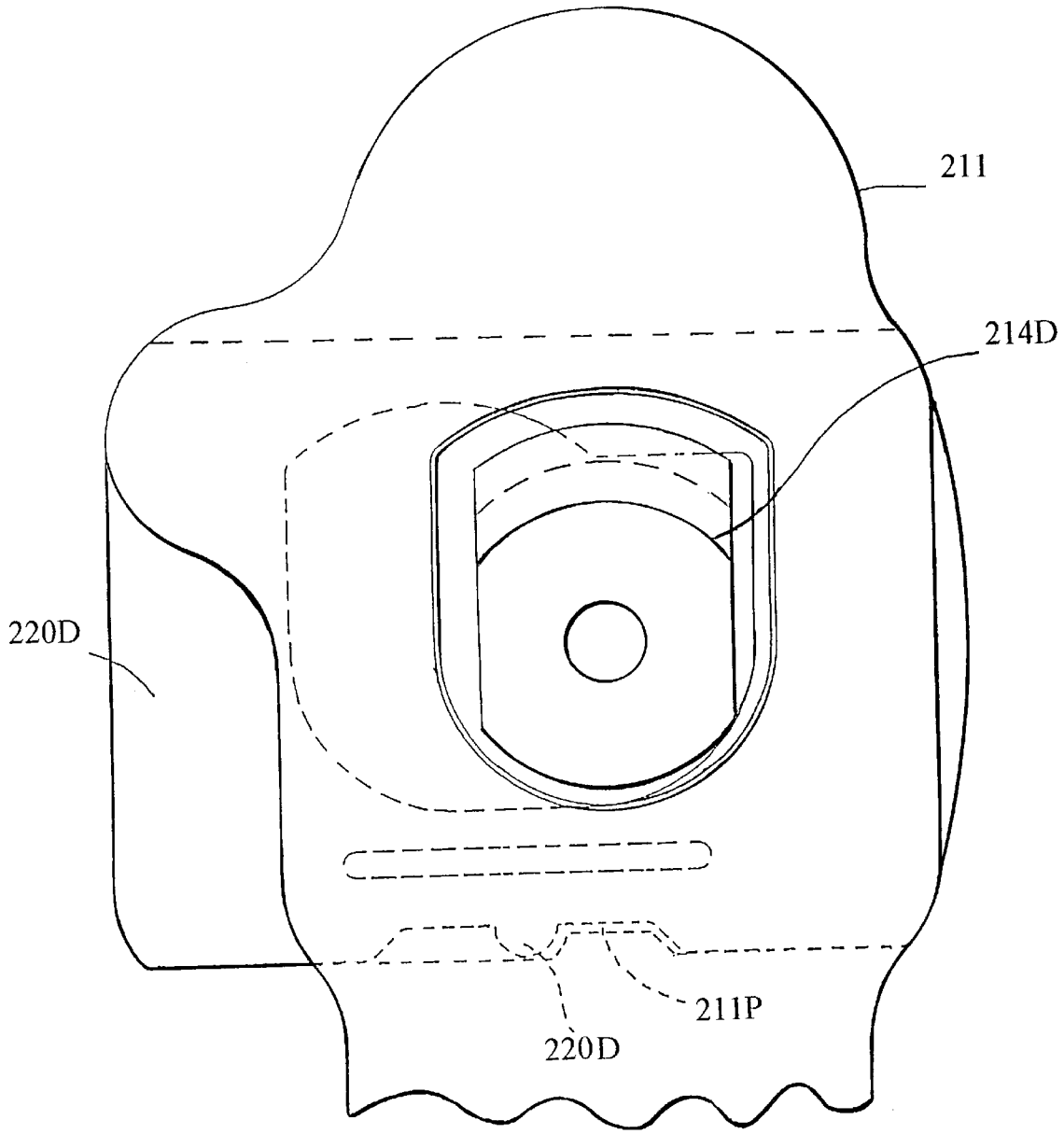
FIG. 35 is a fragmentary side elevational view of the assembled thumbreak and slide of the VERSION III in a latched condition.

The positions of the slide 220 are shown in the drawing, FIG. 34 in an unlatched state and in FIG. 35 as latched.

CONCLUSION

Each of the foregoing supplemental latching devices are readily incorporated into conventional holsters to provide an added degree of security to that given by snap fasteners. The latching device provides a tactile indication of its latched or unlatched state and is so located that it is basically concealed from would-be assailants who might attempt to disarm the wearer. Three different types of sliding movement are disclosed and may be selected depending upon the particular type of holster or application. The cost of the added feature is far outweighed by the extra security provided.

The above described embodiments of the present invention are merely descriptive of its principles and are not to be considered limiting. Instead, this invention is defined by the following claims including the protection afforded by the Doctrine of Equivalents.

We claim:

1. A holster including a supplementary latching device comprising;

a holster body defining a pouch having an opening therein for the insertion and removal of an article to be carried in the pouch;

a strap for securing an article within said pouch;

a snap fastener including a pair of mating fastener parts, one of said pair of mating fastener is a female socket secured to said holster body and the second of said pair of mating fastener parts is a male stud secured to said strap for selectively securing said holster body and said strap together to retain an article in said holster; and said snap fastener including a rimmed capture disk on one of said pair of mating fastener parts; and supplementary latching means slidably movable to engage said rimmed capture disk of said snap fastener to restrict the disengagement of said snap fastener until said supplementary latching means is slidably moved to an unlatched position free of said rimmed capture disk as the wearer grasps the handgun grip and moves his thumb to release the mating fastener parts.

2. A holster in accordance with claim 1 wherein said holster includes a belt loop for belt wearing of said holster with the article to be carried for removal from the pouch of said holster in an upward direction when worn and wherein said supplementary latching means is unlatched by a downward movement of the thumb of the wearer to disengage the supplementary latching means from the snap fastener and by an upward movement to latch the supplementary latching means.

3. A holster in accordance with claim 1, wherein said capture disk is a rimmed cup surrounding one of said pair of snap fastener parts.

4. A holster in accordance with claim 1, wherein said snap fastener includes a male fastener member and a female fastener member and said rimmed capture disk comprises a cup surrounding said male fastener member.

5. A holster in accordance with claim 1 wherein said supplementary latching means includes a thumb tab and said thumb tab is located on an edge thereof and includes a surface for depressing said supplementary latching means and a second surface for raising said supplementary latching means for latching said snap fastener when fastened.

6. A holster in accordance with claim 1 wherein said supplementary latching means includes a thumb tab engagable by the thumb of the wearer of the holster to disengage said supplementary latching means prior to disengaging said snap fastener.

7. A holster in accordance with claim 1, wherein said supplementary latching means includes a valley portion for engaging said rimmed capture disk until said supplementary latching means is moved to disengage said rimmed capture disk.

8. A holster in accordance with claim 6 wherein said thumb tab of said supplementary latching means is located on an edge thereof and includes a surface for depressing said supplementary latching means and a second surface for raising said supplementary latching means to latch said snap fastener from unfastening while said supplementary latching means is in its engaged position.

9. A holster including a supplementary latching device comprising:

a holster body defining a pouch having an opening therein for the insertion and removal of an article to be carried in the pouch;

a strap for securing an article within said pouch;

fastener means including a pair of mating fastener parts, one of said pair of mating fastener parts secured to said holster body and the second of said pair of mating fastener parts secured to said strap for selectively securing said holster body and said strap together to retain an article in said holster;

said fastener means including an outward extending retention portion on one of said pair of mating fastener parts; and supplementary latching means selectively movable to engage said outward extending retention portion of said fastener means to restrict the disengagement of said fastener means until said supplementary latching means in moved to an unlatched position free of said outward extending retention portion;

wherein said holster includes a thumbreak mounting one of said fastener means parts and the second of said pair of fastener means parts is secured to said strap in a position where the fastener means parts are engageable after the strap is extended to retain an article in said pouch; and said supplementary latching means is selectively movable on said thumbreak.

10. A holster in accordance with claim 9 wherein said supplementary latching means encloses a portion of said thumbreak and is in slidable engagement therewith.

11. A holster in accordance with claim 9 wherein said thumbreak includes a recess therein and said supplementary latching means includes detent means which engages said recess when said supplementary latching means is in a latched condition.

12. A holster in accordance with claim 9 wherein said thumbreak is elongated and said supplementary latching means is slidably secured to said thumbreak to move in the direction of elongation of said thumbreak.

13. A holster in accordance with claim 9 wherein said thumbreak is elongated and said supplementary latching means includes a portion fixed with respect to said thumbreak and a portion manually slidable with respect to said thumbreak from latching to unlatching positions.

14. A holster in accordance with claim 13 wherein said manually slidable portion of said supplementary latching means is slidable generally in the direction of the elongation of said thumbreak.

15. A holster in accordance with claim 13 wherein said manually slidable portion of said supplementary latching means is slidable generally transverse to the direction of the elongation of said thumbreak.

16. A holster in accordance with claim 13 wherein said thumbreak is substantially rigid and includes a recess therein in the region of said supplementary latching means and wherein said supplementary latching means includes a spring member movable with said supplementary latching means between latched and an unlatched position with said spring means engaging the recess of said thumbreak when said supplementary latching means is in a latched position.

17. A thumbreak holster comprising:

a holster body having an outer face and an inner face and defining a pouch for carrying a handgun;

a generally rigid thumbreak secured to the inner face of said holster body;

a fastener part on said thumbreak;

a strap secured to the outer face of said holster body;

a mating fastener part on said strap positioned to engage the fastener part on said thumbreak and to secure said strap over a portion of a handgun in said holster and to retain the handgun therein;

an outward extending member in the region of said mating fastener on said strap; and a latching device movably attached to said thumbreak to one position to engage said outward extending member when said fastener parts are secured together and said latching device being movable away from said outwardly extending member to free said fastener for release.

18. A thumbreak holster in accordance with claim 17 wherein said fastener is a snap fastener including a male part and a female part and said outward extending retention portion is a rimmed cup surrounding said male part.

19. A thumbreak holster in accordance with claim 17 wherein said latching device includes a portion slidably engaging the rim of said rimmed cup to prevent the separation of said fastener parts.

20. A thumbreak holster in accordance with claim 17 wherein said latching device slides longitudinally along said thumbreak between latching and unlatching positions.

21. A thumbreak holster in accordance with claim 17 wherein said latching device is secured to said thumbreak for slidable movement transverse to the length of said thumbreak from a latching to an unlatching position.

22. A thumbreak holster in accordance with claim 17 including detent means secured to said latching device and said thumbreak including a recess whereby said detent means extends into said recess when said latching device is in a fastener latching position.

* * * * *